US010894933B2

(12) United States Patent
Omont-Manteghetti et al.

(10) Patent No.: US 10,894,933 B2
(45) Date of Patent: Jan. 19, 2021

(54) CHLORINATED SOLID BLEACHING COMPOSITION WHICH PROTECTS THE FIBRE

(71) Applicant: EUROTAB, St Just St Rambert (FR)

(72) Inventors: Marion Omont-Manteghetti, Saint Just Saint Rambert (FR); Jacques Brosse, La Grand Croix (FR); Maelle Reymond, Rive de Gier (FR)

(73) Assignee: EUROTAB, Rambert (FR)

( * ) Notice: Subject to any disclaimer, the term of this patent is extended or adjusted under 35 U.S.C. 154(b) by 0 days.

(21) Appl. No.: 16/064,683

(22) PCT Filed: Dec. 21, 2016

(86) PCT No.: PCT/FR2016/053593
§ 371 (c)(1),
(2) Date: Jun. 21, 2018

(87) PCT Pub. No.: WO2017/109399
PCT Pub. Date: Jun. 29, 2017

(65) Prior Publication Data

US 2019/0024023 A1 Jan. 24, 2019

(30) Foreign Application Priority Data

Dec. 21, 2015 (FR) ..... 15 62896

(51) Int. Cl.
*B08B 3/04* (2006.01)
*C11D 3/24* (2006.01)
(Continued)

(52) U.S. Cl.
CPC ..... *C11D 3/3955* (2013.01); *C11D 3/42* (2013.01); *C11D 11/0017* (2013.01); *C11D 17/0047* (2013.01); *C11D 17/06* (2013.01)

(58) Field of Classification Search
CPC .. B08B 3/04; C11D 3/24; C11D 3/395; C11D 3/43
See application file for complete search history.

(56) References Cited

U.S. PATENT DOCUMENTS 3,346,502 A 10/1967 Wixon
3,663,442 A 5/1972 Briggs
(Continued)

FOREIGN PATENT DOCUMENTS

CA 738359 A 7/1966
CA 2341188 3/2000
(Continued)

OTHER PUBLICATIONS

European Patent Office—International Search Report of the International Searching Authority dated Mar. 6, 2017 for International Application No. PCT/FR2016/053593 with English translation (7 pgs).
(Continued)

*Primary Examiner* — Brian P Mruk
(74) *Attorney, Agent, or Firm* — Womble Bond Dickinson (US) LLP

(57) ABSTRACT

The present invention relates to a solid bleaching composition comprising at least one chlorinated bleaching and detergent agent selected among the dichloroisocyanurates and at least one optical brightener, characterised in that the pH of said composition is between 5 and 9, and in that the dissolution time of said composition in an aqueous solution is between 30 seconds and 20 minutes. The present invention likewise relates to the use of such a composition for bleaching a fabric, while protecting the textile fibres, as well as disinfecting and washing same.

10 Claims, 2 Drawing Sheets

(51) Int. Cl.

| | |
|---|---|
| ***C11D 3/395*** | (2006.01) |
| ***C11D 3/43*** | (2006.01) |
| ***C11D 3/42*** | (2006.01) |
| ***C11D 17/00*** | (2006.01) |
| ***C11D 11/00*** | (2006.01) |
| ***C11D 17/06*** | (2006.01) |

(56) References Cited

U.S. PATENT DOCUMENTS

| | | | | |
|---|---|---|---|---|
| 3,706,670 | A * | 12/1972 | Gray | C11D 3/3955 510/307 |
| 4,741,858 | A | 5/1988 | Choy et al. | |
| 5,962,387 | A | 10/1999 | Gorlin et al. | |
| 6,015,782 | A | 1/2000 | Petri et al. | |
| 6,204,235 | B1 | 3/2001 | Jimenez Carrillo et al. | |
| 6,486,111 | B1 | 11/2002 | Zabarylo et al. | |
| 8,481,471 | B2 | 7/2013 | Smith et al. | |
| 2005/0113279 | A1 | 5/2005 | Desmarescaux et al. | |
| 2010/0140544 | A1 | 6/2010 | Smith et al. | |

FOREIGN PATENT DOCUMENTS

| | | |
|---|---|---|
| EP | 0481547 | 4/1992 |
| EP | 1352949 | 10/2003 |
| EP | 1865051 | 12/2007 |
| FR | 1453213 A | 6/1963 |
| GB | 955896 A | 4/1964 |
| GB | 1045977 | 10/1966 |
| WO | 9915616 | 4/1999 |
| WO | 2008009804 | 1/2008 |
| WO | 2013084072 | 6/2013 |

OTHER PUBLICATIONS

European Patent Office—Written Opinion of the International Searching Authority dated Mar. 6, 2017 for International Application No. PCT/FR2016/053593 (6 pgs).

Bonnard, et al., "Dichloroisocyanurate de sodium et de potassium." lnrs.fr/fichetox, Base de données Fiches Toxicologiques No. 220, 2011, pp. 1-8.

* cited by examiner

CHLORINATED SOLID BLEACHING COMPOSITION WHICH PROTECTS THE FIBRE

CROSS-REFERENCE TO RELATED APPLICATION

This patent application is a U.S. National Phase application under 35 U.S.C. § 371 of International Application No. PCT/FR2016/053593, filed on 21 Dec. 2016, entitled CHLORINATED SOLID BLEACHING COMPOSITION WHICH PROTECTS THE FIBRE, which claims priority from French Application No. 1562896 filed on 21 Dec. 2015, the content of which are incorporated by reference in their entirety.

The present invention relates to a solid bleaching composition for washing, disinfecting and bleaching laundry while protecting the textile fibres.

In the laundry sector, chlorinated tablets are very often used for disinfection; unlike bleach, however, they are used less often for laundry bleaching.

The disinfecting and bleaching action of the chlorinated compositions used depends on the chemical elements present in solution. In particular, the disinfecting and bleaching power of a chlorinated product is related to the amount of hypochlorous acid and sodium hypochlorite present in solution. The amount of hypochlorous acid is all the greater when the pH of the solution is low and acidic, and sodium hypochlorite is all the more present when the pH of the solution is high and basic. This is shown by the E-pH diagram of chlorine provided in FIG. 1.

Sodium dichloroisocyanurate (NaDCC)-based products have a pH generally around 6, dissolved. Sodium dichloroisocyanurate then reacts with water to form hypochlorous acid. Such products thus have a strong disinfecting power.

Bleach solutions have a pH between 9.5 and 12, contain a large amount of sodium hypochlorite and a limited amount of hypochlorous acid, and thus have a strong bleaching power.

For a given amount of active chlorine, sodium dichloroisocyanurate-based products will have better disinfecting power, and bleach will have better bleaching power. As a result, chlorinated compositions comprising sodium dichloroisocyanurate are rarely used in laundry bleaching.

Thus, in the field of chlorinated products for laundry bleaching, the products most commonly used in the prior art are liquid products based on sodium hypochlorite, i.e., bleach.

However, the storage and use stability of these products still needs to be improved. Indeed, hypochlorite ions are degraded by solar UV rays and heat. In poor storage conditions, therefore, bleach can very rapidly lose its effectiveness and stability. For this reason, the products of the prior art use specific containers and additional additives. Examples include the use of chlorine-stable opacifiers such as a latex to reduce the impact of UV (EP 1 865 051 and U.S. Pat. No. 3,663,442), radical scavengers (WO 99/15616), or a bromide source (U.S. Pat. No. 6,015,782).

It is also known that bleach damages textile fibres during washing and attacks colours, as do most known chlorinated compositions. Without wishing to be bound to any particular theory, the damage to textile fibres may be due to the source of chlorine itself, which may be too aggressive, or to a quantity of chlorine released locally and/or in too great quantity. This wear may also be related to the strongly basic pH of bleaching compositions.

Patent application U.S. Pat. No. 4,741,858 describes a granular bleaching composition based on lithium hypochlorite. In order to make this composition more stable towards certain components and towards fabrics during washing, the proposed solution is to coat the granules with lithium hypochlorite in order to release the chlorine gradually and thus minimize damage to fabrics.

Patent application CA 2 341 188 describes a hypochlorite-based liquid bleaching composition. In order to limit damage to fabrics borate and/or boric acid (reprotoxic compound), combined with a surfactant are added to the composition. In order to improve laundry bleaching, the products of the prior art sometimes use optically functional nanoparticles, such as optical brighteners or ultramarine blue dyes. However, the use of a dispersant is often recommended in such products, especially in liquid compositions, because dyes and brighteners would tend to precipitate. Without the addition of dispersant, the concentration of optically functional nanoparticles would not be homogeneous when using the bleaching composition.

Patent FR 1 453 213 describes in particular a chlorinated composition comprising an optical brightener and sodium tripolyphosphate for its stability; the pH of the solution must be between 9 and 11. The use of sodium tripolyphosphate for laundry is currently prohibited in Europe.

Similarly, patent GB 955,896 describes chlorinated compositions in water-soluble packets comprising an optical brightener and sodium tripolyphosphate, which can thus produce a strongly basic pH. This document therefore does not describe bleaching and detergent compositions having a pH between 5 and 9.

Patent U.S. Pat. No. 3,346,502 describes bleaching compositions in powder form comprising a chlorinated agent, a pigment (ultramarine blue) and a stable optical brightener. The bleaching activity of these compositions is largely due to the presence of the ultramarine blue pigment. In addition, the compositions described may comprise sodium tripolyphosphate, which is banned in Europe, and may produce a strongly basic pH. This document does not describe bleaching and detergent compositions having a pH between 5 and 9.

Patent CA 738359 relates to the improvement of bleaching compositions and describes a composition comprising dichloroisocyanurate, ultramarine blue, an optical brightener and a highly alkaline material. This document does not describe bleaching and detergent compositions which dissolve in aqueous solution within 30 seconds to 20 minutes.

In patent application U.S. Pat. No. 6,204,235, the optical brightener is microencapsulated to provide some stability over time in a chlorinated solution.

Similarly, patent U.S. Pat. No. 3,706,670 describes bleaching compositions comprising potassium dichloroisocyanurate, an optical brightener, and an oxidizable reducing agent in aqueous solution to prevent damage to the optical brightener by the chlorinated agent. This document does not describe a bleaching and detergent composition which dissolves in aqueous solution within 30 seconds to 20 minutes.

Very few chlorinated compositions of the prior art allow both the disinfection and the bleaching of laundry. In addition, most of the compositions concerned are in multilayer tablet form in which the products that are incompatible with one another are separated in different layers. For example, these compositions include one layer comprising the chlorine source and another layer comprising the functional ingredients that are incompatible with chlorine, such as the enzymes or the fragrance (U.S. Pat. No. 8,481,471, EP 0 481 547, WO 2013/084072 and EP 1 352 949).

The present invention relates to a chlorinated solid bleaching composition comprising at least one chlorinated bleaching and detergent agent selected from dichloroisocyanurates and at least one optical brightener, characterized in that the pH of said composition is between 5 and 9, and in that the dissolution time of said composition in aqueous solution is between 30 seconds and 20 minutes.

The present invention makes it possible to obtain the bleaching properties of bleach while protecting the textile fibres. In particular, the invention makes it possible to better preserve the fibres and colours of fabrics during the laundry bleaching process, even after multiple washes, unlike bleach which, because of its excessively high pH and its liquid form (instantaneous dissolution), heavily damages fabrics and colours.

The present invention also makes it possible to obtain a chlorinated composition allowing both the disinfection and the bleaching of laundry. The composition of the invention has in particular a good washing efficiency on oxidizable stains.

The present invention also allows the use of optical brightener without it being necessary to separate it from the chlorinated agent and without it being degraded by chlorine during storage or use. Moreover, due to the solid format of the composition, the amount of brightener is homogeneous for each wash without having to add dispersant or another additive for maintaining a homogeneous dispersion in the product.

The present invention thus makes it possible to prepare a chlorinated bleaching composition which comprises at least one layer/mixture comprising both a chlorinated agent and an optical brightener without the need to separate these compounds. The present invention will thus have the advantage of allowing the preparation of a chlorinated bleaching composition using a simple preparation process, with a reduced number of steps and a reduced number of components and not requiring separation of the various components.

The solid composition according to the present invention also allows a homogeneous and controlled release of chlorine into the washing solution, thus preventing damage to textile fibres due to the release of a large amount of chlorine locally.

The composition according to the present invention thus makes it possible to propose a solution to the various disadvantages encountered in the prior art.

Surprisingly, the inventors discovered that the use of a chlorinated bleaching and detergent agent selected from dichloroisocyanurates and of at least one optical brightener in a chlorinated solid bleaching composition having a pH between 5 and 9 makes it possible to obtain the bleaching properties of bleach while protecting textile fibres and disinfecting laundry.

The inventors noted in particular that when a composition comprising at least one chlorinated bleaching and detergent agent selected from dichloroisocyanurates and at least one optical brightener is at a pH which is too acidic, i.e., below 5, an undesirable interaction is created between the chlorinated agent and the optical brightener within the composition which induces a negative synergy and thus decreases the effectiveness of the chlorine on oxidizable stains as well as the effectiveness of the optical brightener on bleaching; moreover, a pH which is too high, i.e., above 9, amplifies the wear of the fabrics during washing. The pH of the composition of the invention makes it possible to balance the sodium hypochlorite and hypochlorous acid content in the washing solution, while avoiding these disadvantages.

The inventors also discovered that when a certain amount of chlorine is rapidly released locally and/or in too great quantity into the laundry, fabric wear increases substantially.

Therefore, the present invention principally relates to a solid bleaching composition comprising at least one chlorinated bleaching and detergent agent selected from dichloroisocyanurates and at least one optical brightener, characterized in that the pH of said composition is between 5 and 9, and in that the dissolution time of said composition in aqueous solution is between 30 seconds and 20 minutes.

The pH of said composition is advantageously between 6 and 8.5, in particular between 6.5 and 8, more particularly 7.5.

Through misuse of language, the present description will refer to the pH of the solid composition rather than the pH of the solution obtained by dissolving the solid composition at 10% by mass in an aqueous solution.

The pH of the composition of the invention can be measured using a pH meter after dissolving the solid composition in an aqueous solution at 10% by mass. It can also be measured by any other methods known to the one skilled in the art.

The composition of the invention is thus formulated to reach, after dissolution at 10% by mass in an aqueous solution, a pH between 5 and 9, advantageously between 6 and 8.5, in particular between 6.5 and 8, more particularly 7.5.

Preferably, the dissolution time of the solid bleaching composition is between 3 and 15 minutes, in particular between 5 and 15 minutes.

The dissolution time is the time it takes the solid composition to dissolve completely once introduced into the washing solution. The dissolution time is measured in particular in water at 30±1° C. and with stirring at a speed between 150 and 250 rpm. This method is applicable to the measurement of the dissolution time of tablets or powders for washing machines.

The composition of the invention is thus also formulated to dissolve in a washing solution in a time between 30 seconds and 20 minutes, more particularly between 3 and 15 minutes, in particular between 5 and 15 minutes.

Advantageously, the chlorinated bleaching and detergent agent and the optical brightener are not separated in the composition of the invention. The composition of the invention thus comprises at least one homogeneous mixture comprising the chlorinated bleaching and detergent agent and the optical brightener.

The solid composition of the invention can be regarded as physically stable, i.e., it does not undergo any visual change (e.g., appearance of pustules, scaling, colour change, clumping) or behavioural change (e.g., softening, crumbling, disintegration in more than 30 minutes) when exposed to stress conditions such as a temperature of 38° C. and a relative humidity of 70% for 4 weeks.

The solid composition of the invention can also be regarded as chemically stable, i.e., it does not lose more than 15% by weight of active chlorine, based on the total weight of initial active chlorine (measured by iodometric determination with thiosulfate); its components, in particular optical brightener, are not degraded or oxidized by the chlorinated agent; and no excessive decrease in performance (e.g., bleaching, washing results) is observed, when the composition is exposed to stress conditions such as a temperature of 38° C. and a relative humidity of 70% for 4 weeks.

For the purposes of the present invention, "chlorinated bleaching and detergent agent" means a chlorinated agent that releases chlorine into a washing solution and that, when dissolved in the washing solution, has a washing and bleaching action on laundry. Washing or detergent action means the action of removing dirt and/or bacteria from the laundry. Bleaching action means the action of combating the dulling of light colours, especially white, in order to restore the laundry to its original colour without damaging it.

For the purposes of the present invention, "laundry" means all fabric items used as household linen or as clothing. For example, "laundry" means clothing, curtains, sheets, tablecloths, bed linen, hand towels, sleeping bags, tents, tapestries, carpets.

The chlorinated bleaching and detergent agent is more particularly selected from sodium dichloroisocyanurate, potassium dichloroisocyanurate, or a mixture thereof, preferably sodium dichloroisocyanurate.

The potassium and sodium dichloroisocyanurates may be anhydrous or dihydrated.

The potassium and sodium dichloroisocyanurates may be in amorphous or crystalline form.

In aqueous solution, dichloroisocyanurates hydrolyse to form isocyanuric acid, hypochlorous acid (HClO) and corresponding salts, such as sodium hypochlorite (NaClO). The degree of hydrolysis and the hypochlorite ion content depend on the pH.

Preferably, in the composition of the invention, the chlorinated bleaching and detergent agent is the sole chlorine source.

In a particular embodiment of the invention, the chlorinated bleaching and detergent agent is not separated from the other compounds of the composition of the invention. A particular advantage of the present invention is thus to be able to obtain a bleaching composition that is effective and both physically and chemically stable without the need to separate the chlorinated agent from the other compounds.

Advantageously, the solid composition of the invention comprises at least 5% by weight of chlorinated bleaching and detergent agent, in particular between 5% and 99.9%, based on the total weight of the composition.

The content of chlorinated bleaching and detergent agent will be adjusted as a function of the amount of chlorine to be released into a washing bath. The one skilled in the art know that the amount of chlorine to be released must be controlled as a function of the volume of the washing bath. Therefore, for a given volume of washing bath, the content of chlorinated agent will be adjusted as a function of the mass of the solid composition of the invention. The amount of chlorine to be released into the washing bath is generally between 0.02% and 5% by weight relative to 1 litre of washing bath. Therefore, by way of non-limiting example, for a washing bath volume of 15 L and a solid composition of the invention having a mass between 2 g and 30 g, the content of chlorinated bleaching and detergent agent is between 50% and 99.9% by weight, based on the total weight of the composition. Similarly, for a washing bath volume of 15 L and a solid composition of the invention having a mass between 31 g and 50 g, the content of chlorinated bleaching and detergent agent is between 25% and 50% by weight, based on the total weight of the composition. More particularly, still by way of example, for a washing bath volume of 15 L and a solid composition of the invention of 2 g, the content of chlorinated bleaching and detergent agent is between 80% and 99.9% by weight, based on the total weight of the composition. Similarly, for a washing bath volume of 15 L and a solid composition of the invention of 5 g, the content of chlorinated bleaching and detergent agent is between 60% and 99.9% by weight, based on the total weight of the composition.

For the purposes of the present invention, "optical brightener" means a compound that absorbs ultraviolet electromagnetic radiation between 300 nm and 400 nm wavelength and then re-emits this energy by fluorescence in the visible range between 400 nm and 500 nm, i.e., the wavelengths between blue-violet and blue-green with a maximum in the blue. The optical brightener, when applied to a material, therefore adds to the range of visible light and thus give the material a whiteness effect.

In the context of the present invention, the optical brightener is dispersed homogeneously in the composition of the invention. Furthermore, the optical brightener is not degraded by chlorine during storage or use of the composition of the invention.

The optical brightener may in particular be selected from disulphonic acid derivatives, bis-(triazinylamino)-stilbene derivatives, flavonic acid derivatives, naphthalimide derivatives, pyrene derivatives, diaminostilbene (DAS) derivatives, mono- or polysulphonated 4-4'-distyryl-biphenyl (DSBP), 4,4'-bis-(4-chloro-2-sulphostyryl)diphenyl, sodium 4,4'-bis(2-sulphostyryl)biphenyl, methylumbelliferone, coumarin, dihydroquinolinone, 1,3-diaryl-pyrazoline, benzoxazole, benzimidazole, benzisoxazole.

Advantageously, the solid composition of the invention comprises from 0.01% to 10% by weight of one or more optical brighteners, based on the total weight of the composition. Just as for the chlorinated bleaching and detergent agent, the content of optical brightener will be adjusted as a function of the amount to be released into the washing bath. The amount of optical brightener to be released into the washing bath is generally between 0.0005% and 0.1% by weight relative to 1 litre of washing bath. Therefore, by way of non-limiting example, for a washing bath volume of 15 L and a solid composition of the invention having a mass between 2 g and 30 g, the content of optical brightener will be between 0.01% and 10% by weight, based on the total weight of the composition. Similarly, for a washing bath volume of 15 L and a solid composition of the invention having a mass between 31 g and 50 g, the content of optical brightener will be between 0.05% and 5% by weight, based on the total weight of the composition.

Preferably, the composition of the invention comprises at least one agent which acts on the dissolution of the composition, such as an effervescent agent, a disintegrating agent, a bursting agent or a mixture thereof.

For the purposes of the present invention, "effervescent agent" means a compound capable of releasing gas when brought into contact with water or another liquid. More particularly, the effervescent agent allows the composition to fragment and/or dissolve rapidly in water or another liquid, especially in a washing solution. The effervescent agent may in particular be selected from organic acids, anhydrides thereof or salts thereof (such as adipic acid, citric acid, malic acid, tartaric acid, malonic acid, fumaric acid, maleic acid, succinic acid and mixtures thereof), carbonates or bicarbonates (such as sodium carbonate or bicarbonate, potassium carbonate or bicarbonate, calcium carbonate or bicarbonate, magnesium carbonate or bicarbonate and mixtures thereof), and a mixture thereof. Advantageously, the effervescent agent is a bicarbonate, in particular sodium bicarbonate. More advantageously, the effervescent agent is a mixture of sodium bicarbonate and an organic acid, particularly adipic acid or citric acid. Preferably, the effervescent agent is a sodium bicarbonate/adipic acid pair.

For the purposes of the present invention, "disintegrating agent" means a solid compound that is soluble in an aqueous solution and dissolves rapidly in aqueous solution, which improves the permeability of a solid composition when brought into contact with an aqueous solution. The disintegrating agent may in particular be selected from alginic acid, carboxymethyl cellulose calcium, carboxymethyl cellulose sodium, colloidal silicon dioxide, croscarmellose sodium, crospovidone, guar gum, magnesium aluminium silicate, methyl cellulose, microcrystalline cellulose, polacrilin potassium, cellulose powder, pregelatinized starch, sodium alginate, starch, carboxymethyl starch, corn starch, potato starch, sodium starch glycolate, calcium carbonate, cross-linked carboxymethyl cellulose, low-substituted hydroxypropylcellulose, carmellose, sodium carmellose, calcium carmellose, agar, carob, karaya, pectin, tragacanth gum, bentonite, cation-exchange resin, polyvinylpyrrolidone, cross-linked polyvinylpyrrolidone, alginates, potassium polacrilin, citrus pulp, sodium lauryl sulphate, and mixtures thereof.

For the purposes of the present invention, "bursting agent" means a compound which increases the rate of disintegration and/or dissolution of a solid composition by swelling, plastic deformation, wicking effect, when it comes into contact with water or another liquid. The bursting agent may in particular be selected from modified or unmodified starches, starch derivatives, modified or unmodified celluloses, cellulose derivatives, cross-linked polyacrylates, cross-linked polyvinylpyrrolidones, polysaccharides, alginates such as alginic acid and sodium alginate, aluminium silicate derivatives, silica and/or gums and derivatives, and mixtures thereof.

Advantageously, the composition of the invention comprises between 0% and 70% by weight, preferably between 0.01% and 70% of at least one agent acting on the dissolution of the composition, such as an effervescent agent, a disintegrating agent, a bursting agent or mixtures thereof, based on the total weight of the composition.

Persons skilled in the art know that the amount of agent(s) acting on the dissolution of the composition is adjusted as a function of the dissolution time to be obtained, the total volume of the washing bath and the amount of chlorinated agent and optical brightener present in the composition. Therefore, by way of non-limiting example, for a washing bath volume of 15 L and a solid composition of the invention having a mass between 2 g and 30 g, the content of agent(s) acting on the dissolution of the composition will be between 0% and 40% by weight, preferably 0.01% and 40% based on the total weight of the composition. Similarly, for a washing bath volume of 15 L and a solid composition of the invention having a mass between 31 g and 50 g, the content of agent(s) acting on the dissolution of the composition will be between 40% and 70% by weight, based on the total weight of the composition.

Preferably, the agent acting on dissolution is at least one effervescent agent and at least one disintegrating agent, in particular a pair of effervescent agents and a disintegrating agent. In this context, the disintegrating agent may be more particularly croscarmellose sodium and the effervescent agent will be in particular selected from carbonates and bicarbonates, in particular sodium bicarbonate, citric acid and adipic acid, and mixtures thereof, or a sodium bicarbonate/adipic acid and sodium bicarbonate/citric acid pair. More advantageously, the agent acting on dissolution is a mixture of sodium bicarbonate and an organic acid, in particular adipic acid or citric acid. Preferably, the agent acting on dissolution is a sodium bicarbonate/adipic acid or sodium bicarbonate/citric acid pair.

In the context of the present invention, the nature and content of the effervescent agent or of the pair of effervescent agents also make it possible to reach, after dissolution at 10% by mass in an aqueous solution, a pH between 5 and 9, advantageously between 6 and 8.5, in particular between 6.5 and 8, more particularly 7.5. Therefore, when the effervescent agent pair is a sodium bicarbonate/adipic acid or sodium bicarbonate/citric acid pair, the sodium bicarbonate/acid ratio is adjusted to obtain the target pH. This ratio will be more particularly between 95:5 and 40:60, in particular between 95:5 and 50:50, more particularly between 95:5 and 70:30, advantageously between 95:5 and 80:20, more advantageously between 95:5 and 90:10.

The solid composition of the invention may also comprise at least one additional additive, such as an inert filler, a surfactant, a pH regulator, an enzyme, an antifoam agent, a binder, a fragrance or a dye. These additional additives are for example as defined in patent application EP 1 352 949.

When a surfactant is added to the solid composition, it will be advantageously anionic.

The composition of the invention comprises less than 15% by weight, preferably less than 10% by weight, of an additional additive, based on the total weight of the composition. Therefore, the composition of the invention has the advantage of being particularly simple, i.e., it advantageously comprises less than seven components, preferably less than six components, in particular less than five components.

Preferably, the solid bleaching composition as described above comprises, by weight based on the total weight of the composition:

- between 5% and 99.9% of a chlorinated bleaching and detergent agent selected from dichloroisocyanurates,
- from 0.01% to 10% of at least one optical brightener,
- between 0% and 70% of at least one agent acting on the dissolution of the composition, such as an effervescent agent, a disintegrating agent, a bursting agent or mixtures thereof,
- between 0% and 0.30% of fragrance; and
- less than 15% of another additional additive.

In particular, when the washing bath has a volume of 15 L and the solid bleaching composition as described above has a weight between 2 g and 30 g, it comprises, by weight based on the total weight of the composition:

- between 50% and 99.9% of a chlorinated bleaching and detergent agent selected from dichloroisocyanurates,
- between 0.1% and 10% of at least one optical brightener,
- between 0% and 40% of at least one agent acting on the dissolution of the composition, such as an effervescent agent, a disintegrating agent, a bursting agent or mixtures thereof,
- between 0% and 0.30% of fragrance; and
- less than 10% of another additional additive.

In particular, when the washing bath has a volume of 15 L and the solid bleaching composition as described above has a weight between 31 g and 50 g, it comprises, by weight based on the total weight of the composition:

- between 25% and 50% of a chlorinated bleaching and detergent agent selected from dichloroisocyanurates,
- between 0.05% and 5% of at least one optical brightener,
- between 40% and 70% of at least one agent acting on the dissolution of the composition, such as an effervescent agent, a disintegrating agent, a bursting agent or mixtures thereof,
- between 0% and 0.30% of fragrance; and
- less than 10% of another additional additive.

In particular, the composition of the invention is free of sodium tripolyphosphate.

In the context of the present invention, the solid bleaching composition may be in the form of granules, powder or a solid tablet.

When the composition of the invention is in the form of powder or granules, its dissolution may be delayed in particular by incorporating the composition into a water-soluble packet (pouch) or by incorporating into the composition. For the purposes of the present invention, "water-soluble packet" or "pouch" means a packet suitable for containing powder and dissolving in a controlled manner in an aqueous solution.

Preferably, the solid bleaching composition is in the form of a solid tablet.

For the purposes of the present invention, "solid tablet" means a compacted composition consisting of a set of particles compactly grouped in such a way that they can be handled without breaking up.

When the composition of the invention is in the form of a solid tablet, it is possible to adjust the dissolution time, for example by modifying the proportion of effervescent agent, particularly by modifying the ratio of the effervescent pair, by modifying the proportion of disintegrating and/or bursting agent, by applying a higher or lower compression force during preparation, by adding a surfactant to slow dissolution, by changing the tablet's shape or weight.

The tablet of a chlorinated composition of the invention may consist of one layer or of a stack of several layers superimposed on one another, thus forming a uniform and compact block. The layers may be of similar or different compositions, or even of similar or different colours.

In the context of the present invention, the tablet of the invention preferably comprises at least one layer comprising both the chlorinated agent and the optical brightener. When an agent acting on the dissolution of the composition is present in the composition, the tablet of the invention preferably comprises at least one layer comprising both the chlorinated agent, the optical brightener, and the agent acting on the dissolution of the composition. Preferably, the tablet of the invention consists in a single layer.

The tablet can have a cylindrical shape with a section of any shape, such as a circular, oval, octagonal, or parallelepipedic shape. When the section of the compacted composition is parallelepipedic, typically square or rectangular, the corners of the compacted composition can be curved so that they are less brittle. Each layer has the same section so that the stack they form is uniform. The compacted composition can also have any other geometric shape (e.g., star, diamond).

The tablet has a mass between 1 g and 250 g, advantageously between 1 g and 100 g, more advantageously between 2 g and 50 g, and especially between 2 g and 20 g.

The tablet has a mechanical strength between 10 N and 5000 N, advantageously between 30 N and 3000 N, more preferably between 50 N and 1500 N.

The chlorinated composition of the invention, compacted in tablet form, may in particular be manufactured according to the following preparation process:

a) homogeneously mixing the various components, including at least one chlorinated bleaching and detergent agent, at least one optical brightener, to form a composition;
b) pre-compacting the composition, in particular by direct compression, for example on rotary presses;
c) optionally, introducing on the first layer obtained in step b) a composition as obtained in step a) to form a second layer and then pre-compacting the new composition as carried out in step b);
d) optionally repeating step c) as many times as there are necessary layers; and
e) compacting the layer obtained in step b) or all the layers obtained in step c) or d), in particular by direct compression, for example on rotary presses, to obtain a compacted composition.

The pre-compaction forces used are in particular between 5 kN and 200 kN, advantageously between 5 kN and 100 kN, and more advantageously between 10 kN and 80 kN. The compaction force used is in particular between 20 kN and 1000 kN, advantageously between 40 kN and 600 kN, and more advantageously between 60 kN and 250 kN.

The compacted composition thus obtained is shock-resistant.

The present invention also relates to the use of a solid bleaching composition as described above for bleaching a textile.

In particular, the present invention relates to the use of a solid bleaching composition as described above for bleaching a textile while protecting the textile fibres.

The present invention also relates to the use of a solid bleaching composition as described above for bleaching a textile while disinfecting and washing, in particular washing oxidizable stains.

Figure 1:
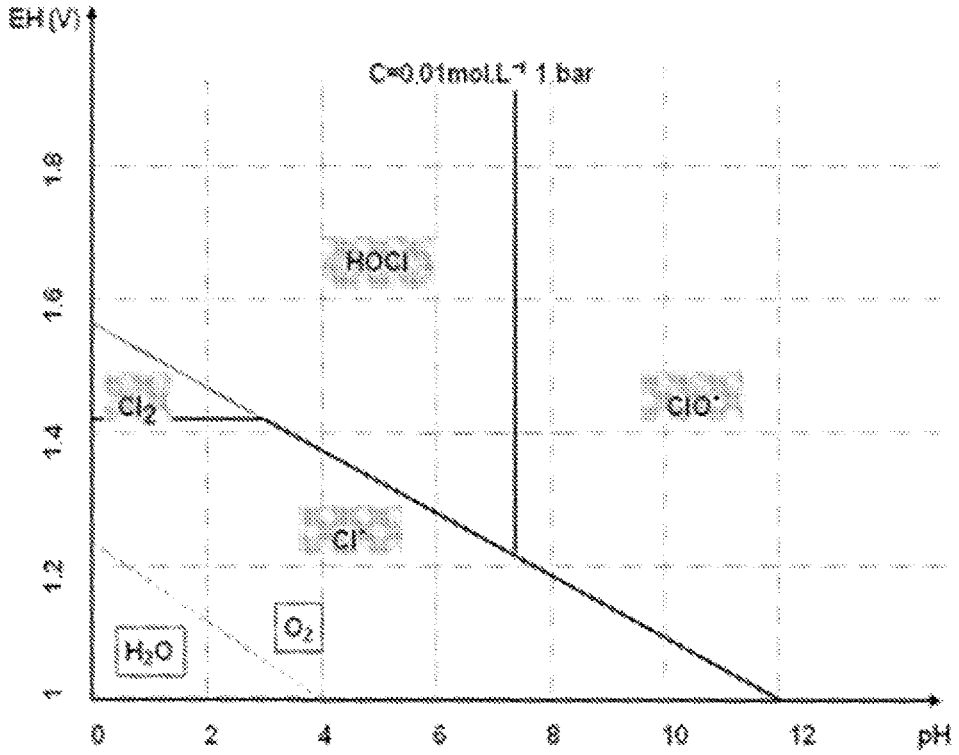
FIG. 1 shows the E-pH diagram of chlorine.

The following examples are intended to illustrate the present invention.

EXAMPLES

Example 1: Preparation of Solid Compositions of the Invention

The following compositions are prepared by mixing the various ingredients listed in Table 1 below:

TABLE 1

| | composition of the mixtures prepared according to the invention | | | | | |
|---|---|---|---|---|---|---|
| Ingredient | 1 | 2 | 3 | 4 | 5 | 8 |
| Chlorinated agent | NaDCC (64.1%) | NaDCC (64.1%) | NaDCC (64.1%) | NaDCC (64.1%) | NaDCC (64.1%) | NaDCC (64.1%) |
| Optical brightener | Distyryl- | Distyryl- | Distyryl- | Distyryl- | Distyryl- | Tetrabenzo- |

TABLE 1-continued

| composition of the mixtures prepared according to the invention | | | | | | |
|---|---|---|---|---|---|---|
| Ingredient | 1 | 2 | 3 | 4 | 5 | 8 |
| | biphenyl derivative (0.3%) | biphenyl derivative (0.5%) | biphenyl derivative (0.3%) | biphenyl derivative (0.3%) | biphenyl derivative (0.3%) | tetraazaporphine derivative (0.3%) |
| Effervescent agent 1 | Sodium bicarbonate (32.8%) | Sodium bicarbonate (32.6%) | Sodium bicarbonate (32.8%) | Sodium bicarbonate (32.4%) | Sodium bicarbonate (33.4%) | Sodium bicarbonate (32.8%) |
| Effervescent agent 2 | Adipic acid (2%) | Adipic acid (2%) | Adipic acid (2%) | Adipic acid (2%) | Adipic acid (2%) | Adipic acid (2%) |
| Disintegrating agent | Croscarmellose sodium (0.6%) | Croscarmellose sodium (0.6%) | Croscarmellose sodium (0.6%) | Croscarmellose sodium (1%) | Croscarmellose sodium (0%) | Croscarmellose sodium (0.6%) |
| Fragrance | Silica/fragrance premix (0.2%) | Silica/fragrance premix (0.2%) | Silica/fragrance premix (0.2%) | Silica/fragrance premix (0.2%) | Silica/fragrance premix (0.2%) | Silica/fragrance premix (0.2%) |
| Format | 5-g tablet | 5-g tablet | Powders | 5-g tablet | 5-g tablet | 5-g tablet |
| pH | 7.5 | 7.5 | 7.5 | 7.5 | 7.5 | 7.5 |

Percentages are Expressed as Mass Relative to the Total Mass of the Composition

When the solid composition is in tablet form, the mixtures obtained are then compressed using a 20-mm-diameter cylindrical tool on a 100-MPa hydraulic press.

The pH of the solid compositions is measured according to the following method:

Preparation: the solid composition is dissolved in 20° C. tap water, at 10% by mass.

Equipment:

1 IMMO LABO 008 pH meter

Standard solutions (buffer solution) at pH 7 and 4 and/or 10.

A magnetic bar, a magnetic stirrer

Procedure:

Calibrating the pH meter with the pH 7, pH 4, then pH 10 standard solutions

Measuring the desired solution

Recording the pH value read on the display after stabilization.

The pH values obtained from these measurements are as follows:

| | Composition | | | | | |
|---|---|---|---|---|---|---|
| | 1 | 2 | 3 | 4 | 5 | 8 |
| pH | 7.5 | 7.5 | 7.5 | 7.5 | 7.5 | 7.5 |

Example 2: Tests of the Effectiveness of the Compositions of the Invention

In order to measure the effectiveness of the compositions of the invention, the following tests are performed:

Bleaching test;

Test of chemical wear of the fabric;

Washing efficiency test;

Colour preservation test; and

Dissolution test.

These tests are carried out on the 5 compositions cited in Example 1. The results are then compared with the results obtained for the 5 control compositions described in the following Table 2:

TABLE 2

| control compositions | | | | |
|---|---|---|---|---|
| Ingredient | 6 | 7 | 9 | 10 |
| Chlorinated agent | ACE bleach with 3% active chlorine | NaDCC (64.1%) | NaDCC (64.1%) | NaDCC (64.1%) |
| Optical brightener | | 0% | Distyryl-biphenyl derivative (0.3%) | Distyryl-biphenyl derivative (0.3%) |
| Effervescent agent 1 | | Sodium bicarbonate (33.1%) | Metasilicate (32.8%) | Sodium bicarbonate (5.8%) |
| Effervescent agent 2 | | Adipic acid (2%) | Adipic acid (2%) | Adipic acid (29%) |
| Dis-integrating agent | | Croscarmellose sodium (0.6%) | Croscarmellose sodium (0.6%) | Croscarmellose sodium (0.6%) |
| Fragrance | | Silica/ fragrance premix (0.2%) | Silica/ fragrance premix (0.2%) | Silica/ fragrance premix (0.2%) |
| Format | Liquid | 5-g tablet | 5-g tablet | 5-g tablet |
| pH | 11-12 | 7.5 | 11 | 3 |

Percentages are expressed as mass relative to the total mass of the composition

Bleaching and Fabric Wear Test Conditions:

Washing machine: Miele Softtronic W5794 front-loading drum washing machine with a maximum capacity of 7 kg.

Cycle used: 30° C.

Number of washes: 25 washes with cumulative effect.

Water hardness: 25±2 French degrees.

Laundry load: 4.5 kg of cotton tea-towels.

Introduction method: The products are introduced into the machine's detergent dispenser at the beginning of the wash cycle.

Fabric tests: Two oversewn cotton samples (40 cm×30 cm) meeting the specifications developed in standard ISO 2267 are introduced into the machine:

nature: pure cotton, minimum commercial length: 27 mm weave: cloth number of warp threads: 25±2 threads per centimetre number of weft threads: 25±2 threads per centimetre single yarn measurement: 30±2 tex (tex=weight in g of 1 km of yarn)

twist: 700±25 twists/m weight per square meter: 170±10 g

Measurement Method: Chemical Wear—Degree of Polymerization

Chemical wear results from the degrading action of certain products on the cellulose macromolecules of the fibres and of the fabric during washing.

The determination of the average degree of polymerization of cellulose is performed by measuring the viscosity at 25° C. of a solution of a cotton sample tested in a suitable solvent relative to the viscosity of the solvent itself.

Two measurements are taken per strip, i.e., 4 measurements per product.

The higher the value obtained, the less the fabric wear. The lower the value obtained, the greater the fabric wear.

A difference of 100 points is considered significant.

Measurement Method: Whiteness According to the Ganz Formula (with UV)

Whiteness (W) and tint deviation (TV) are calculated according to the equations:

$$W=D\times Y+P+x+Q\times y+C$$

with:

D, P, Q and C: spectrophotometer constants

Y, x, y: colorimetric values $$\mathrm{TV}=m\times x+n\times y+k$$

with:

m, n and k: spectrophotometer constants x and y: colorimetric values

If TV is between:

−0.5 and 0.5: TD=N® no deviation in tint

−0.5 and −1.5: TD=R1® slight deviation in tint in the red

−1.5 and −2.5: TD=R2® visible deviation in tint in the red

−2.5 and −3.5: TD=R3® large deviation in tint in the red 0.5 and 1.5: TD=G1® slight deviation in tint in the green 1.5 and 2.5: TD=G2® visible deviation in tint in the green 2.5 and 3.5: TD=G3® large deviation in tint in the green A difference of 10 points is considered significant.

Tests Conditions for Washing Efficiency on Oxidizable Stains:

Washing machine: Miele Novotronic W980 front-loading drum washing machine with a maximum capacity of 5 kg.

Cycle used: Washing: Rise in temperature: 5 minutes

Plateau at 30° C.: 30 minutes

Water volume: 15 litres

Rinses: Three: 11, 11, 11 minutes

Water volume: 14 litres

Spins: Three: 2, 4, 7 minutes

Total cycle time: 81 minutes

Number of washes: Removal of dirt and stains: 3, without cumulative effect.

Whiteness: 3, with cumulative effect.

Water hardness: 25±2 French degrees.

Laundry load: 3 kg of cotton tea-towels.

Note: loads were pre-washed at 60° C. with brightener-free ECE detergent.

Introduction method: The products are introduced into the machine's detergent dispenser at the beginning of the wash cycle.

Fabric tests: Per wash, the following 2 series of fabrics (cotton) are introduced by pinning to the tea-towels:

EQUEST tea

EQUEST tomato sauce

EQUEST red wine

CFT CS15 blueberry

CFT CS08 grass

Additional soiling: 4 WFK-SBL 2004 samples per wash.

Measurement Method: Removal of Dirt and Stains

Spectrophotometric measurements (measurements of the amount of light reflected by the fabric) are used to calculate the percentages of dirt removal.

Dirt removal is expressed by the formula:

$$\text{Removal in } \% = \frac{C-B}{A-B}\times 100$$

A=reflectance of the white control sample

B=reflectance of the soiled control sample

C=reflectance of the soiled sample after washing

Reflectances are determined using the green trichromatic component, without the action of optical brighteners.

Number of measurements per sample=2

Number of samples per wash=2

Number of washes=3

Therefore, 2×2×3=12 measurements per stain and per product.

In the classifications below, two products are deemed significantly different if the difference between them is 2 points or more.

Colour Preservation Test Conditions:

Washing machine: Miele Novotronic W838 front-loading drum washing machine with a maximum capacity of 7 kg.

Cycle used: 30° C.

Number of washes: 6 washes with cumulative effect.

Water hardness: 25±2 French degrees.

Laundry load: 4.5 kg of cotton tea-towels.

Introduction method: The products are introduced into the machine's detergent dispenser at the beginning of the wash cycle.

Fabric tests: Two oversewn cotton samples (40 cm×30 cm) are introduced into the machine:

| | |
|---|---|
| Fabric 475 | pink cotton |
| Fabric 130 | purple cotton |
| Fabric 497 | orange cotton |
| Fabric 134 | orange cotton |
| Fabric 132 | black cotton |
| Fabric 133 | blue cotton |
| Fabric 476 | blue cotton |
| Fabric 496 | blue cotton |

Measurement Method: Colour Preservation

Spectrophotometric measurements (measurements of the amount of light reflected by the fabric) are used to calculate the percentages of dirt removal.

Dirt removal is expressed by the formula:

$$\text{Removal in } \% = \frac{C-B}{A-B}\times 100$$

A=reflectance of the white control sample

B=reflectance of the soiled control sample

C=reflectance of the soiled sample after washing

Reflectances are determined using the green trichromatic component, with the action of optical brighteners.

Number of measurements per sample=4

Number of samples per wash=2

Therefore, 2×4=8 measurements per coloured fabric.

In the classifications below, two products are deemed significantly different if the difference between them is 2 points or more.

Procedure for Measuring the Dissolution Time:

This method is applicable to the measurement of the dissolution time of tablets or powders for washing machines.

Principle: The method used makes it possible to simulate the dissolution of a tablet or powder in a washing machine drum and, in parallel, to monitor changes in the level of active chlorine released into the water.

Procedure:

- Filling a beaker with 1.8 L of 30±1° C. tap water
- Placing the beaker on a magnetic stirrer and place a medium-sized magnetic bar in the bottom of the beaker
- Placing a cage in the top of the beaker so that the cage is submerged while being as high as possible→only for a tablet
- Setting the stirring speed between 150 and 250 rpm.
- Placing the electrode for monitoring active chlorine release into the water so that it is sufficiently soaked to take the measurement.
- Placing the tablet in the cage at the top of the beaker, or the powder directly into the water, while starting the stopwatch
- Observing the melting of the pellet in the cage and/or the disappearance of residues in the bottom of the beaker
- In parallel with the dissolution, the active chlorine is measured by iodometric determination with thiosulfate and monitored over time on the computer connected to the electrode.
- Recording the time when there are no more residues in the cage and in the beaker
- Stopping the measurement and the stopwatch when the amount of active chlorine in the water stabilizes (meaning that the dissolution is complete) or reaches a maximum and then begins to decrease.

Results:

The results of the above-mentioned tests are grouped in the following Table 3:

TABLE 3

| | results | | | | | | | | | | |
|---|---|---|---|---|---|---|---|---|---|---|---|
| | | Composition | | | | | | | | | |
| Parameters | 1 (4*5 g) | 1 (2*5 g) | 2 (2*5 g) | 3 (20 g) | 4 (4*5 g) | 5 (4*5 g) | 6 (170 ml) | 7 (4*5 g) | 8 (4*5 g) | 9 (4*5 g) | 10 (4*5 g) |
| Dissolution (min) | 5 | 5 | 5 | 30 s | 2 | 12 | <5 ms | 5 | 5 | 5 | 5 |
| pH | 7.5 | 7.5 | 7.5 | 7.5 | 7.5 | 7.5 | 11-12 | 7.5 | 7.5 | 11 | 3 |
| Washing efficiency | 61.8 | 41.9 | 41.9 | 61.7 | 61.7 | 61 | 28.6 | 61.1 | 61.5 | 44.1 | 45.2 |
| Whitening | 167 | 157 | 168 | 165 | 165 | 160 | 174 | 110 | 125 | 162 | 135 |
| Chemical wear | 1748 | 1708 | 1698 | 1363 | 1431 | 1750 | 1127 | 1725 | 1710 | 1255 | 1723 |
| Colour wear | 17.96 | 17.25 | 17.32 | 23.26 | 20.23 | 16.5 | 28.56 | 19.87 | 18.9 | 22.45 | 15.02 |

For the tests concerning fibre protection, bleaching, and washing efficiency on oxidizable stains, the higher the results, the better. Respectively, the higher the results, the more the product bleaches, removes oxidizable stains, and is gentle to fabrics. For the colour preservation test, the higher the results, the more the colour is worn, and the lower the results, the better the colours are preserved.

Figure 2:
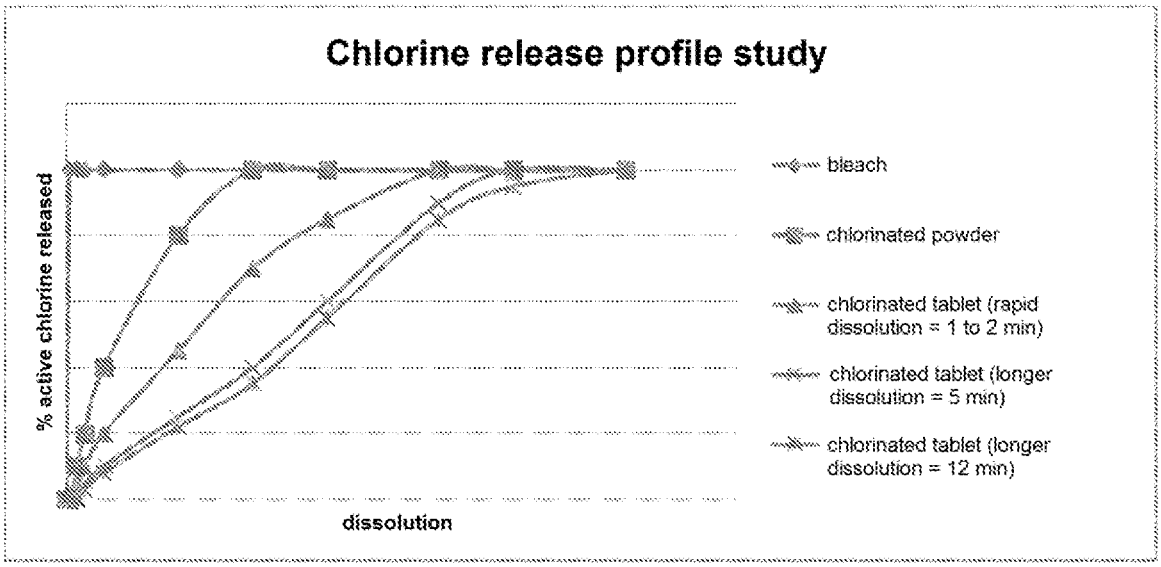
FIG. 2 shows the chlorine release profile in a washing solution comprising bleach (♦), composition 3 (■), composition 4 (▲), composition 1 (x) and composition 5 (Ж).
Figure 3:
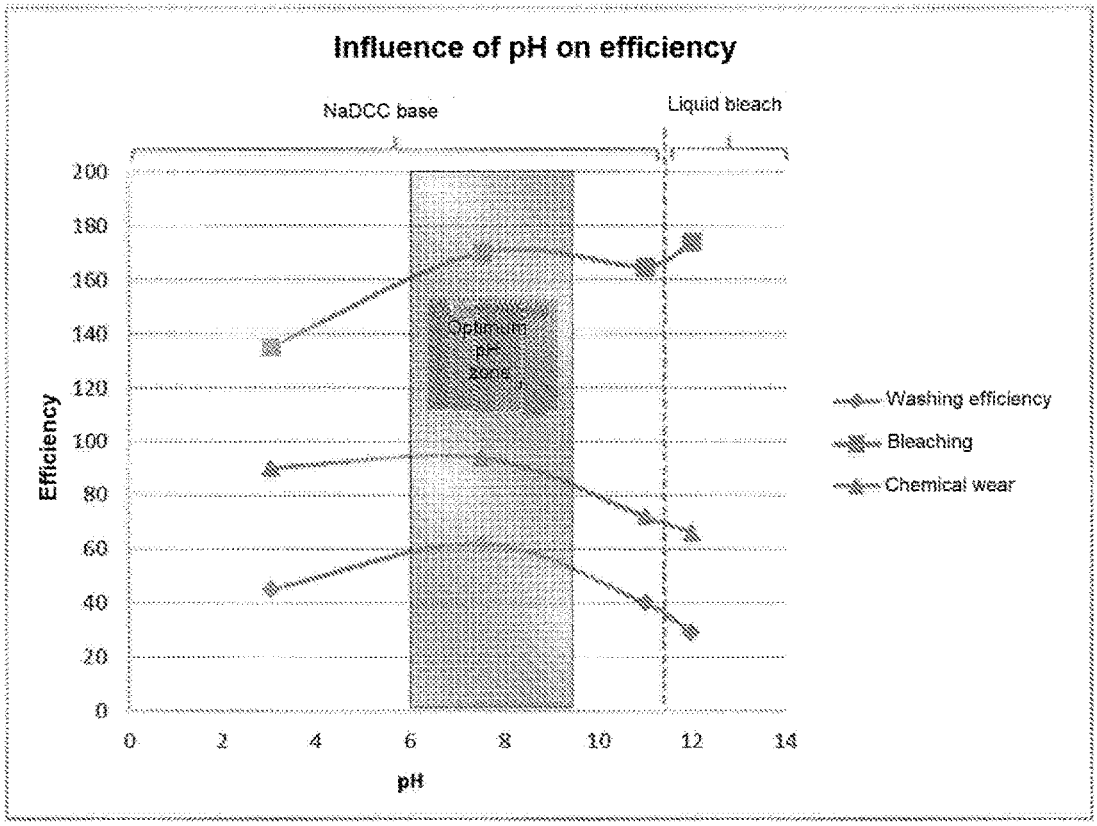
FIG. 3 shows the influence of pH on washing efficiency (♦), bleaching efficiency (■), and chemical wear (▲) of a fabric for a liquid bleach solution and a sodium dichloroisocyanurate (NaDCC) solution.
Figure 4:
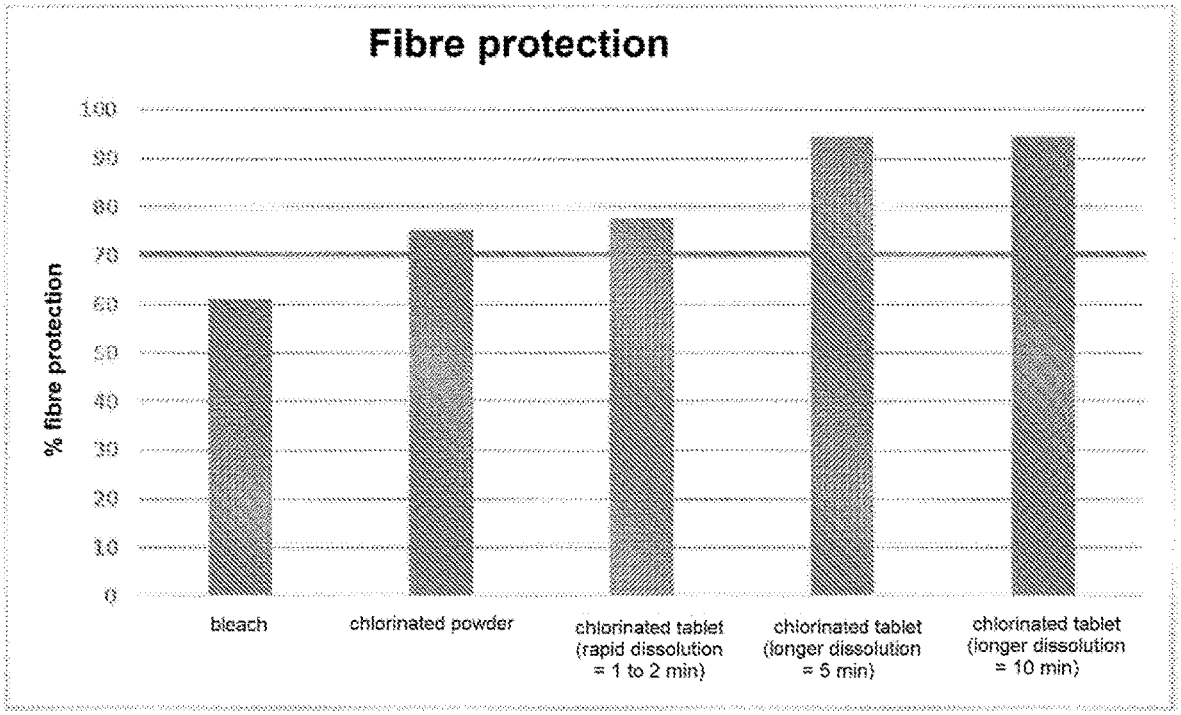
FIG. 4 shows the influence of the tested compositions on the protection of a fabric's fibre.

FIG. 2 shows the chlorine release profile in the washing solution. FIGS. 3 and 4, respectively, show the influence of pH on washing and bleaching efficiency and on chemical wear of the fabric, and the influence of the compositions studied on fibre protection.

It can be seen from these graphs that the bleach immediately releases its amount of active chlorine into the washing bath. The composition of the invention in powder form releases the active chlorine very rapidly but, owing to its composition (pH and nature of the chlorine), the fabrics are preserved better than by washing with bleach. The compositions of the invention in solid tablet form allow a more gradual release of the active chlorine and therefore preserve fabrics better. All this for the same result in terms of bleaching.

Example 3: Examples of Solid Compositions of the Invention

The solid compositions of the invention may in particular correspond to the following compositions:

| Name | Mass in %* |
|---|---|
| Sodium dichloroisocyanurate | 80.77 |
| Sodium bicarbonate | 18.93 |
| Disodium 2,2'-([1,1'-biphenyl]-4,4'-diyldivinylene)bis(benzenesulphonate) | 0.30 |
| Total | 100.00 |
| pH | 7.5 |
| Dissolution time | 5 minutes |

| Name | Mass in %* |
|---|---|
| Sodium dichloroisocyanurate | 64.10 |
| Sodium bicarbonate | 32.80 |
| Adipic acid | 2.00 |
| Disodium 2,2'-([1,1'-biphenyl]-4,4'-diyldivinylene)bis(benzenesulphonate) | 0.30 |
| Croscarmellose sodium | 0.60 |
| Fragrance premix | 0.20 |

-continued

| Name | Mass in %* |
|---|---|
| Total | 100.00 |
| pH | 7.5 |
| Dissolution time | 5 minutes |

| Name | Mass in %* |
|---|---|
| Sodium dichloroisocyanurate | 64.10 |
| Sodium bicarbonate | 32.60 |
| Adipic acid | 2.00 |
| Disodium 2,2'-([1,1'-biphenyl]-4,4'-diyldivinylene)bis(benzenesulphonate) | 0.50 |
| Croscarmellose sodium | 0.60 |
| Fragrance premix | 0.20 |
| Total | 100.00 |
| pH | 7.5 |
| Dissolution time | 5 minutes |

| Name | Mass in %* |
|---|---|
| Sodium dichloroisocyanurate | 64.10 |
| Sodium bicarbonate | 13.40 |
| Adipic acid | 19.00 |
| Disodium 2,2'-([1,1'-biphenyl]-4,4'-diyldivinylene)bis(benzenesulphonate) | 0.50 |
| Sodium laurylsulphoacetate | 3.00 |
| Total | 100.00 |
| pH | 5.5 |
| Dissolution time | 5 minutes |

*Percentages are expressed as mass relative to the total mass of the composition

What is claimed is:

1. A method for bleaching a textile while protecting the fibre, said method comprising dissolving in a washing solution a solid bleaching composition, wherein said composition comprises 50 to 99.9% by weight of a chlorinated bleaching and detergent agent selected from dichloroisocyanurates and 0.1 to 10% by weight of an optical brightener, and wherein the pH of said composition is between 5 and 9, and the dissolution time of said composition in aqueous solution is between 30 seconds and 20 minutes.

2. The method of claim 1, wherein the pH of said composition is between 6 and 8.5.

3. The method of claim 1, wherein the dissolution time of said composition in aqueous solution is between 3 minutes and 15 minutes.

4. The method of claim 1, wherein said chlorinated bleaching and detergent agent is sodium dichloroisocyanurate, potassium dichloroisocyanurate, or a mixture thereof.

5. The method of claim 1, wherein the pH of said composition is between 6.5 and 8.

6. The method of claim 4, wherein said solid bleaching composition is in the form of a solid tablet, granules, or powder.

7. The method of claim 1, wherein said solid bleaching composition is in the form of a solid tablet.

8. The method of claim 1, wherein said optical brightener is selected from disulphonic acid derivatives, bis-(triazinylamino)-stilbene derivatives, flavonic acid derivatives, naphthalimide derivatives, pyrene derivatives, diaminostilbene (DAS) derivatives, mono- or polysulphonated 4-4'-distyryl-biphenyl (DSBP), 4,4'-bis-(4-chloro-2-sulphostyryl)diphenyl, sodium 4,4'-bis(2-sulphostyryl) biphenyl, methylumbelliferone, coumarin, dihydroquinolinone, 1,3-diaryl-pyrazoline, benzoxazole, and benzimidazole, benzisoxazole.

9. The method of claim 1, wherein said solid bleaching composition further comprises at least one additional additive.

10. The method of claim 1, wherein said solid bleaching composition comprises, by weight based on the total weight of the composition:

between 50% and 99.9% of a chlorinated bleaching and detergent agent selected from dichloroisocyanurates, from 0.1% to 10% of at least one optical brightener, between 0% and 40% of at least one agent acting on the dissolution of the composition, between 0% and 0.30% of fragrance; and less than 10% of another additional additive.

* * * * *